US006116220A

United States Patent [19]

Geiger et al.

[11] Patent Number: 6,116,220

[45] Date of Patent: Sep. 12, 2000

[54] FUEL INJECTION PUMP WITH AN INJECTION ADJUSTING PISTON USED FOR ADJUSTING THE ONSET OF INJECTION

[75] Inventors: Wolfgang Geiger, Remshalden; Thomas Kulder, Steinheim; Andreas Sterr, Nuertingen; Wakter Fuchs, Stuttgart; Bernd Berghaenel, Illingen; Dieter Reitz, Muehltal; Wolfgang Fehlmann, Stuttgart, all of Germany

[73] Assignees: Robert Bosch GmbH; Adam Opel AG, a part interest, both of Stuttgart, Germany

[21] Appl. No.: 09/043,647

[22] PCT Filed: Apr. 26, 1997

[86] PCT No.: PCT/DE97/00862

§ 371 Date: May 12, 1998

§ 102(e) Date: May 12, 1998

[87] PCT Pub. No.: WO98/04822

PCT Pub. Date: Feb. 5, 1998

[30] Foreign Application Priority Data

Jul. 25, 1996 [DE] Germany ..... 196 29 947

[51] Int. Cl.[7] ..... F02M 37/04

[52] U.S. Cl. ..... 123/502; 123/495

[58] Field of Search ..... 123/502, 495, 123/501, 500, 449

[56] References Cited

U.S. PATENT DOCUMENTS

| | | | |
|---|---|---|---|
| 4,748,958 | 6/1988 | Ash | 123/502 |
| 5,263,457 | 11/1993 | Konrath | 123/502 |
| 5,551,399 | 9/1996 | Collingborn | 123/502 |
| 5,638,794 | 6/1997 | Kubo | 123/502 |

FOREIGN PATENT DOCUMENTS

| | | | |
|---|---|---|---|
| 44 40 749 | 5/1996 | Germany | 123/502 |

*Primary Examiner*—Carl S. Miller

*Attorney, Agent, or Firm*—Ronald E. Greigg; Edwin E. Greigg

[57] ABSTRACT

A fuel injection pump, with an injection adjusting piston that serves to adjust the onset of injection, in which due to an off-center coupling to a cam part of the cam drive of a fuel injection pump embodied as a distributing injection pump, the injection adjusting piston is subjected to tilting moments during operation. In addition, the injection adjusting piston is subjected to other forces by means of a radially produced pressure fluid supply on a side of the injection adjusting piston disposed essentially opposite the coupling, and these other forces, together with the tilting moment forces, produce high, one-sided pressure loads in the radial direction on the injection adjusting piston. By producing a second pressure field, the injection adjusting piston undergoes a compensation of the above-mentioned forces acting on the injection adjusting piston and consequently experiences a significantly reduced radial load.

18 Claims, 4 Drawing Sheets

FUEL INJECTION PUMP WITH AN INJECTION ADJUSTING PISTON USED FOR ADJUSTING THE ONSET OF INJECTION

PRIOR ART

The invention is based on a fuel injection pump with an injection adjusting piston used for adjusting the onset of injection. DE-A-35 32 719 has disclosed an injection pump of this kind in which the control pressure for the injection onset adjustment prevails in the inner pump chamber and this pressure is supplied to the injection adjusting piston and to the control slide valve by way of the central region. The connection between the injection adjusting piston and the cam drive is embodied so that a sliding block is supported centrally in the region of the axis of the injection adjusting piston and the coupling part can engage in the sliding block perpendicular to the rotational movement of the sliding block. The control slide valve is disposed in a region of the injection adjusting piston adjoining the sliding block, to the side of a spring disposed in a bore of the injection adjusting piston and this spring is used as a restoring force and loads an end face of the injection adjusting piston. The pressure chamber defined in this bore by the control slide valve is disposed inside the injection adjusting piston and the control spring is supported so that it is fixed to the housing, parallel to the restoring spring that loads the injection adjusting piston. This embodiment of the injection adjusting piston is symmetrically loaded by the forces engaging it so that no significant tilting moments act on it.

With increased demands on the injection adjuster, it is necessary to accommodate the pressure chamber, which acts on the control slide valve, outside the injection adjusting piston, which is, however, connected with an increased demand for space in the axial direction of the injection adjusting piston. In order to compensate for this problem, the injection adjusting piston must be shorter and the control slide valve must be accommodated in a region of the injection adjusting piston that is simultaneously used to couple the injection adjusting piston to the cam drive. The reaction forces from the cam drive that no longer act on the injection adjusting piston coaxially but rather eccentrically due to this construction, generate tilting moments on the injection adjusting piston, which put a strain on the guidance of the injection adjusting piston in its cylinder. In addition, this construction requires another supply of the control pressure fluid, which must be provided in the central region of the injection adjusting piston and which additionally generates a pressure field on the injection adjusting piston, which in turn radially loads the injection adjusting piston and partially intensifies the radial forces between the injection adjusting piston and the cylinder resulting from the tilting moment.

ADVANTAGES OF THE INVENTION

By means of the fuel injection pump according to the invention, with the features set forth herein, in an injection adjusting piston, which is loaded on one side by reaction forces from the cam drive and additionally has a pressure fluid supply that intensifies the forces resulting from the one-sided loading, a possibility will now be provided in order to compensate for this one-sided loading of the injection adjusting piston and its guidance in such a way that the forces acting perpendicularly on one side, between the injection adjusting piston and the cylinder are reduced.

In an advantageous embodiment, in the recess in the injection adjusting piston, the coupling part encloses a pressure chamber in which a second pressure field is generated, which counteracts the first pressure field generated by the recess that is loaded by the pressure fluid source. On the side opposite from the injection adjusting piston the pressure field is absorbed by the coupling part which belongs to the cam drive and is supported in the housing of the fuel injection pump.

In another advantageous embodiment of the invention is, an additional recess is provided between the jacket face of the injection adjusting piston and the wall of the cylinder and the second pressure field is embodied in the region of this additional recess and acts in a compensating manner on the tilting moments produced by the first pressure field and the cam drive. This embodiment requires an additional structural expense in relation to the above-mentioned embodiment, but is not problematic with regard to the sealing of the pressure chamber, which is required in the former embodiment.

Advantageously, the recess and the additional recess are each embodied as a longitudinal slot and are disposed in a common annular region of the jacket face of the injection adjusting piston.

Another advantageous embodiment of the invention is comprised of providing locations on the cylinder that guides the injection adjusting piston, on both sides of the coupling part, which locations respectively generate a second pressure field for compensation of the first pressure field and the moments to which the injection adjusting piston is subjected. Advantageously, the injection adjusting piston is guided in a cylinder sleeve made of abrasion resistant material inserted into the housing of the fuel injection pump. This assures optimal sliding properties between the injection adjusting piston and the cylinder sleeve and a reliability against failure.

In an advantageous manner and with a low manufacturing cost, the connection between the locations disposed essentially opposite the recess can furthermore be realized between the jacket face of the injection adjusting piston and the wall of the cylinder by virtue of the fact that the connecting conduits leading to these locations, which conduits are disposed between the cylinder sleeve and the housing, are incorporated in the form of grooves. To improve the sealing of the work chamber enclosed in the cylinder by the injection adjusting piston, this chamber has a metallic sealing ring that rests elastically against the inner jacket face of the cylinder or the cylinder sleeve. As a result, the sealing of the work chamber is assured even in the regions of the injection adjusting piston that are not subjected to such high radial forces.

BRIEF DESCRIPTION OF THE DRAWINGS

Four exemplary embodiments of the invention are represented in the drawings and will be explained in detail in the description below.

DESCRIPTION OF THE EXEMPLARY EMBODIMENTS

Figure 1:
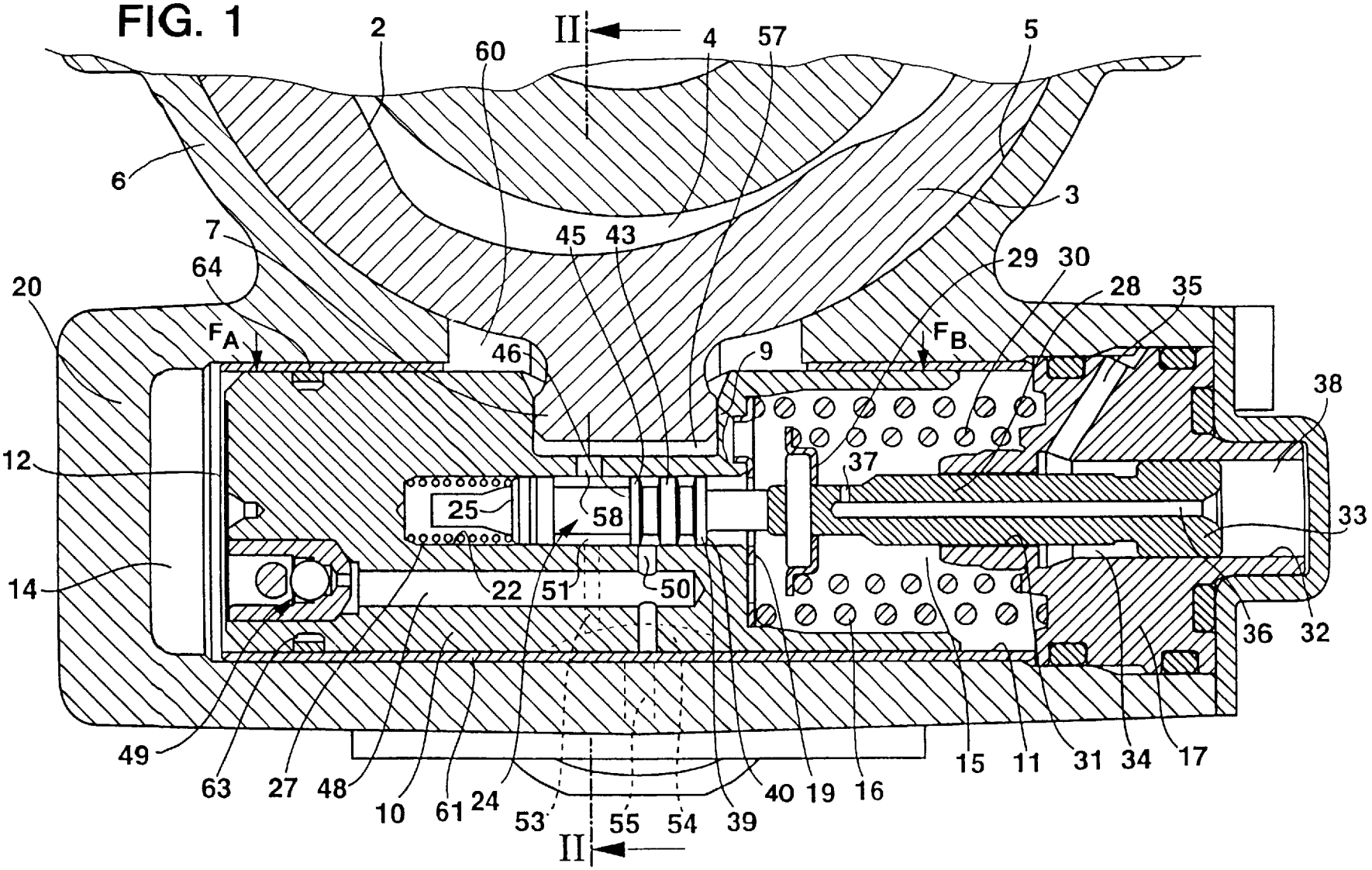
FIG. 1 shows a first exemplary embodiment of the invention, with a pressure chamber that is enclosed by the coupling part and the injection adjusting piston and is for producing a compensating second pressure field.

Fuel injection pumps of the distributing type can either be provided as pumps with an axially driven pump piston that serves as both the distributor and the pump piston, or radial pistons can be provided, which feed radially into a feed conduit disposed in a distributor. In both instances, the pump pistons are actuated by a cam drive that is set in motion by the drive shaft of the fuel injection pump. A part of this kind of a so-called radial piston pump is represented in sectional form in FIG. 1. In pumps of this kind, for example four pump pistons, not shown here, are provided, which are supported so that they can move in a sealed fashion in radial bores in the distributor that jointly extend radial to the axis of the distributor, at the same angular distance from one another. On their one end face, they enclose a common pump work chamber which is filled with fuel in a known manner during the radial outward stroke of the pump pistons and during the radial inward stroke of the pump pistons, is connected via a pressure line to a distributor opening on the jacket face of the distributor, wherein the distributor opening controls injection lines branching off from the circumference of the distributor, each of which is supplied with fuel that is brought to injection pressure during the inward movement of the pump pistons. The distributor is driven to rotate by a drive shaft in such a way that on the one hand, the distributor opening can carry out its control function and on the other hand, the pump pistons are moved in the circumference direction along a cam track. This construction is not shown here in detail since it is assumed to be generally known. A part of the cam track 2 is shown, which is disposed on the inside of a cam ring 3 and which the pump pistons follow. The cam ring 3 represents the essentially stationary part of the cam drive of the pump pistons. While the device that moves the pump pistons, which can, for example, be the ring or distributor that guides the roller tappets and is coupled to the drive shaft, represents the moving part of the cam drive. The cam ring is supported with its outer circumference in a cylindrical recess 5 in the housing 6 of the fuel injection pump and can be rotated in a plane perpendicular to the drive axis of the fuel injection pump. Through the rotational position of the cam ring, the time of each respective feed stroke onset of the pump pistons can now be changed in relation to the drive motion of the distributor. For rotation, the cam ring 3 has a coupling part in the form of a pin 7 that protrudes radially out from the cam ring and is of one piece with it, and this pin projects into a recess 9 of an injection adjusting piston 10.

The injection adjusting piston can slide in a sealed fashion in a cylinder 11 and, with its one end face 12, encloses a work chamber with the closed end of the cylinder 11 and with its other end face 11, encloses a spring chamber 15 disposed in the cylinder 11 that is also enclosed there. A restoring spring 16 is disposed in this spring chamber and is supported on one end against a closing part 17 that closes the cylinder and on the other end against the end face 19 of the injection adjusting piston 10 and is clamped so that it strives to bring the injection adjusting piston with its one end face 12 into contact with the wall 20 that closes the cylinder 11 on the opposite side or into contact with a stop disposed there.

Furthermore, a cylinder bore 22 is provided in the injection adjusting piston 10, in the form of an axial blind bore which leads from the end face 19. With its one end face 25, a control slide valve 24 inserted there encloses a pressure relieved end chamber with the closed end of the blind bore, and a compression spring 27 is clamped into this end chamber, and this spring loads the control slide valve 24 on this end face 25 and secures it with its other end in contact with a tappet 28 that projects into the spring chamber 15. This tappet has a spring plate 29 there, against which a control spring 30 is supported, which is supported on the other end against the closing part 17. The tappet is guided in a bore 31 of the closing part 17 and protrudes into a cylinder 32 which is disposed inside the closing part 17. At that point, the tappet transitions into a piston 33, which slides in a sealed fashion in the cylinder and on the spring chamber end, encloses a work chamber 34 with the tappet, which chamber is supplied with pressure fluid via a bore 35. This pressure fluid is kept at a control pressure, which is essentially speed dependent, but can also be varied as a function of other parameters of the internal combustion engine, for example as a function of the load. The pressure is produced in a known manner in a control pressure source, which is not shown in detail here. When the pressure in the work chamber 34 increases, the tappet is slid together with the piston 33 counter to the force of the control spring 30. This movement is followed by the control slide valve 24, supported by the compression spring 27.

The control spring 30 disposed coaxially and parallel to the restoring spring 16 in the spring chamber 15 is bathed by fuel which is supplied from the spring chamber 15 to a relief chamber as a leakage quantity or diversion quantity. The spring chamber 15 also communicates with the chamber 38 enclosed in the cylinder 32 on the other end of the piston 33, in fact via an axial bore 36 in the tappet 28, which exits via a radial bore 37 in the tappet, inside the spring chamber 15.

Figure 2:
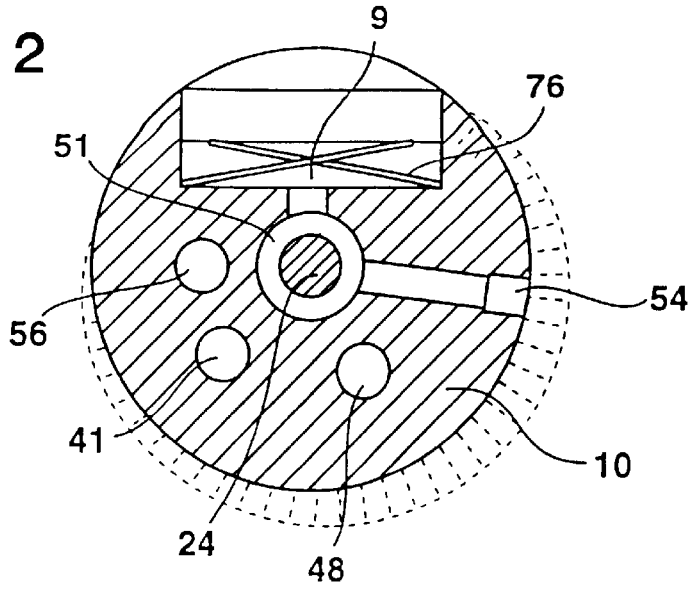
FIG. 2 is a longitudinal section through the exemplary embodiment according to FIG. 1, along the line II—II in FIG. 1, with a second embodiment of the invention using a compensating compression spring.

The control slide valve 24 has three annular collars disposed close to one another, of which a first annular collar 39, which is disposed on the spring chamber end, has a control edge 40 on the spring chamber end, via which a relief conduit 41, not shown here in the drawing, that leads from the axial blind bore 22 to the work chamber 14 is opened in the direction of the spring chamber 15 when there is a particular relative position of the control slide valve 24 and the injection adjusting piston 10 in relation to each other. This relief conduit 41 is shown in FIG. 2.

Toward the end of the work chamber 14, the first annular collar 39 is followed by a second annular collar 43, which is used to guide the control slide valve and at the same time, to moderate a pressure relief shock. This annular collar 43 is then followed by a third annular collar 45, which has a control edge 46 toward the end of the work chamber 14, which controls a filling conduit 48 that leads from the axial blind bore and feeds into the work chamber 14 via a check valve 49. If this control edge produces the connection between the exit 50 of the filling conduit 48 and an annular groove 51 that adjoins the control edge on the end of the work chamber 14, then fuel under control pressure, which is simultaneously also actuation pressure, is conducted into the work chamber 14 via the filling conduit. The annular groove continuously communicates with a recess 54 in the jacket face of the injection adjusting piston via a supply conduit 53. The recess, which is embodied as a longitudinal groove along a jacket line of the injection adjusting piston continuously communicates with a pressure fluid supply 55, which preferably leads from the control pressure source that also supplies the work chamber 34. The association of this longitudinal groove for feeding the pressure fluid supply 55 into the cylinder is assured through the coupling of the injection adjusting piston 10 to the pin 7 of the cam ring. The position of this longitudinal groove 54 can be inferred from FIG. 2 and is only symbolically drawn with dashed lines in FIG. 1.

This embodiment of the injection onset adjuster with the injection adjusting piston 10 operates so that when the control pressure increases, the piston 33 is slid toward the right counter to the force of the control spring 30 and as a result, the control slide valve 24 also moves toward the right. Starting from the position shown in FIG. 1, then the control slide valve with the control edge 46 opens the communication between the filling conduit 48 and the annular groove 51 or the pressure fluid supply 55. Additional pressure fluid flows via the check valve 49 into the work chamber 14, which in turn brings about the fact that the injection adjusting piston 10 is slid toward the right counter to the force of the restoring spring 16 until the mouth 50 of the filling conduit 48 is closed again by the control edge 46. In the intermediary region, the injection adjusting piston 10 can be slid further toward the right without a communication occurring between the work chamber 14 and the pressure fluid supply 55 or between the spring chamber 15 and relief chamber. The mouth 15, rather, continues to be sealed when it reaches the second annular collar and the relief conduit, not shown here, is opened only when the control slide valve moves toward the left due to a pressure release in the work chamber 34. The spring chamber 15 and the end chamber of the axial blind bore communicate with each other via a line 56 so that the control slide valve is hydraulically pressure balanced on both ends.

The recess 9 in the jacket face of the injection adjusting piston is circular in cross section so that the pin 7 encloses a pressure chamber 57 in this recess. This pressure chamber continuously communicates with the annular groove 51 via a short bore 58 and is subjected to the control pressure.

In the region of the entry of the pin 7 into the recess, the housing 6 has a recess 60 that connects the internal chamber 4 of the fuel injection pump to the cylinder 11 in such a way that the pin 7 can follow the adjusting movements of the injection adjusting piston 10 in an unhindered manner. In this region, the jacket face of the injection adjusting piston 10 is subjected to a low internal chamber pressure of the fuel pump, which pressure is on the same order of magnitude as the relief pressure and therefore does not significantly load the injection adjusting piston in the radial direction.

So that the injection adjusting piston can be guided with as little abrasion as possible with the presence of the high forces acting on it, by taking into consideration the fact that the housing 6 of the injection pump is comprised, for example, of diecast aluminum, a cylinder sleeve 61 is provided as the cylinder, which is comprised of high-grade steel and is inserted or press-fitted into a corresponding cylindrical bore in the housing. The injection adjusting piston itself is likewise comprised of high-grade steel, which can at the same time also have a corresponding surface tempering to increase the abrasion resistance. Furthermore, for a sealed guidance of the injection adjusting piston, particularly at the end of the work chamber 14, an annular groove 63 is incorporated into the jacket face of the injection adjusting piston 10 and a metallic piston ring 64 is inserted into this annular groove, which assures a high-quality seal.

The injection adjusting piston 10 and the piston 33, together with the tappet 28 and springs 16 and 30 require a particular amount of space. The actuating piston, which is disposed outside the injection adjusting piston 10 and is comprised of a tappet and piston 33, requires an additional amount of space in comparison to other embodiments of an injection adjuster. For this reason, the injection adjusting piston is kept shorter on the end of the spring chamber 15 so that certain predetermined structural dimensions of the injection adjuster can be maintained. Therefore for space-saving reasons, the control slide valve, in particular, also extends over the region in which the cam ring 3 is coupled to the injection adjusting piston 10 by means of the pin 7. This in turn requires an eccentric engagement of the pin 7 against the injection adjusting piston and under the load of a longitudinal force to be axially applied, resulting from the pressure in the work chamber 14 and a restoring force transmitted from the cam ring 3, a lever arm is produced between the engagement point of the pin 7 against the injection adjusting piston 10 and the axis of the injection adjusting piston 10, which lever arm, together with these forces, exerts a tilting moment on the injection adjusting piston. This tilting moment must be counteracted by means of pressure loads and restraint moments. Furthermore, the injection adjusting piston is loaded by the pressure field disposed toward the bottom in the drawings or, with regard to FIG. 2, disposed essentially toward the bottom, and this pressure field is increased by the pressure loads FA and FB, which have been representatively drawn here with dotted lines. The pressure field which leads, as a first pressure field, from the longitudinal groove 54 is schematically represented in FIG. 2 as the first pressure field 66. Together with the pressure loads, which result from the tilting moment, the surface pressure increases on the side of the cam ring between the injection adjusting piston 10 and the cylinder 11. Increased forces in connection with material properties and roughnesses of the material pairings can lead to the failure of the component.

By virtue of the fact that the control pressure is now introduced into the pressure chamber 57, a second pressure field is produced there, which partially counteracts the first pressure field and the tilting forces. In this manner, the radial loading of the injection adjusting piston can be significantly reduced without requiring significant structural changes to the injection adjusting piston. Care need only be taken that the pin 7 encloses the pressure chamber 57 in a relatively sealed manner and the pin functions with its end face as a support face in connection with the bearing of the cam ring 3. Due to the longitudinal movement of the injection adjusting piston 10, the connecting pairing between the pin 7 and the recess 9 must be designed in such a way that even slight pivoting movements of the pin in relation to the injection adjusting piston 10 can be carried out. Preferably the pin is embodied as ball-shaped at the connecting point to the injection adjusting piston 10. In order to keep the abrasion low in this instance as well, the parts that touch one another here are hardened. In particular, even the injection adjusting piston 10 is case-hardened for abrasion reasons.

In lieu of a hydraulically produced pressure field in the region of the recess 57, this second pressure field can be realized by means of an opposing force which is produced by a compression spring 76 clamped between the pin 7 and the recess 57, as shown in FIG. 2.

Figure 4:
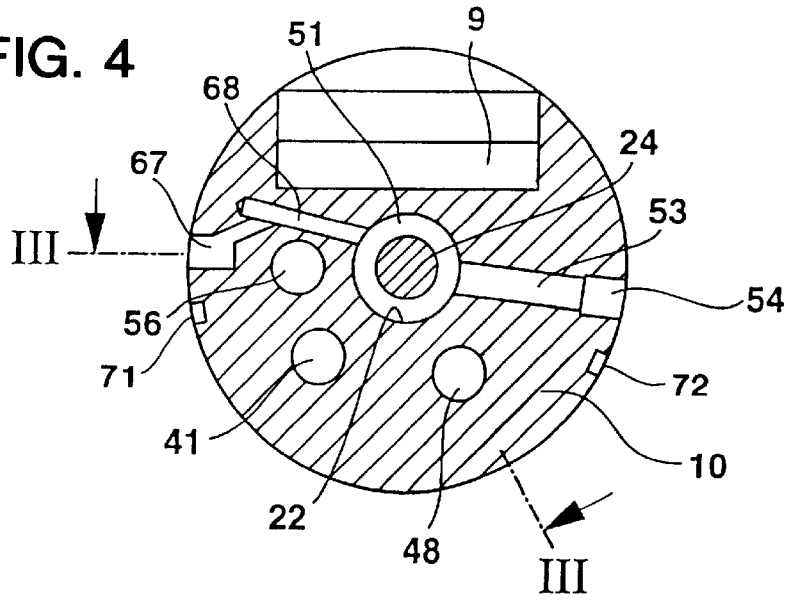
FIG. 4 shows a section through the exemplary embodiment according to FIG. 3, along the line IV—IV from FIG. 3.
Figure 3:
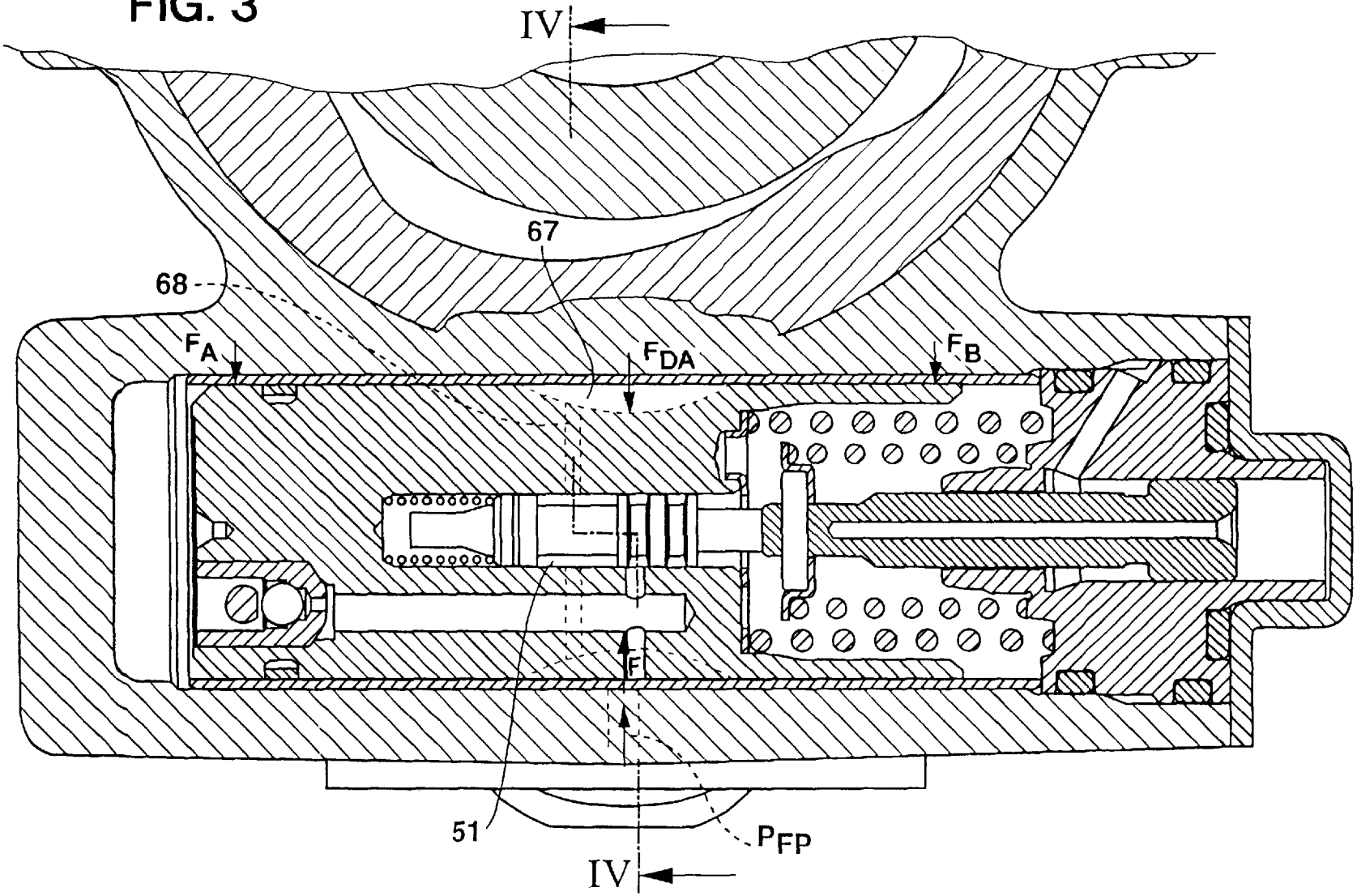
FIG. 3 shows a third exemplary embodiment of the invention, represented in the form of a longitudinal section through an injection adjusting piston of the fuel injection pump.

In a further modification in relation to the exemplary embodiment according to FIG. 1, according to the embodiment according to FIG. 3, the second pressure field which was realized in the pressure chamber 57 is realized in the form of an additional longitudinal groove 67 in the jacket face of the injection adjusting piston. The piston and its drive, as shown in FIG. 3, are embodied essentially identically, as in the exemplary embodiment according to FIG. 1. Consequently, the description of this Fig. in this regard can be dispensed with. The section according to FIG. 3, however, shows a view which is produced from the section III—III in FIG. 4. It can be inferred from FIG. 4 that the additional longitudinal groove 67 is disposed essentially diametrically opposite the longitudinal 54. The communication between the annular groove 51 and this additional longitudinal groove 67 is produced by a connecting line 68. The second pressure field being generated in the additional longitudinal groove 67 is of the same magnitude as the pressure field being generated in the longitudinal groove 54. Consequently, the forces arising from these pressure fields cancel each other out so that the radial load of the injection adjusting piston 10 is significantly reduced.

It is furthermore advantageous if the pressure fields can be definitely sized in order to precisely adjust the desired pressure balancing. To that end, additional channels 71, 72 are respectively provided on the side remote from the recess 9, spaced apart from and parallel to the longitudinal grooves 67 and 54, and are longer than these grooves 67 and 54, and protruding past them, feed into the spring chamber 15 with their one end. Consequently, the pressure field is respectively relieved in the direction of the spring chamber at the location of the additional channels and is thus limited in the circumference direction.

Figure 5:
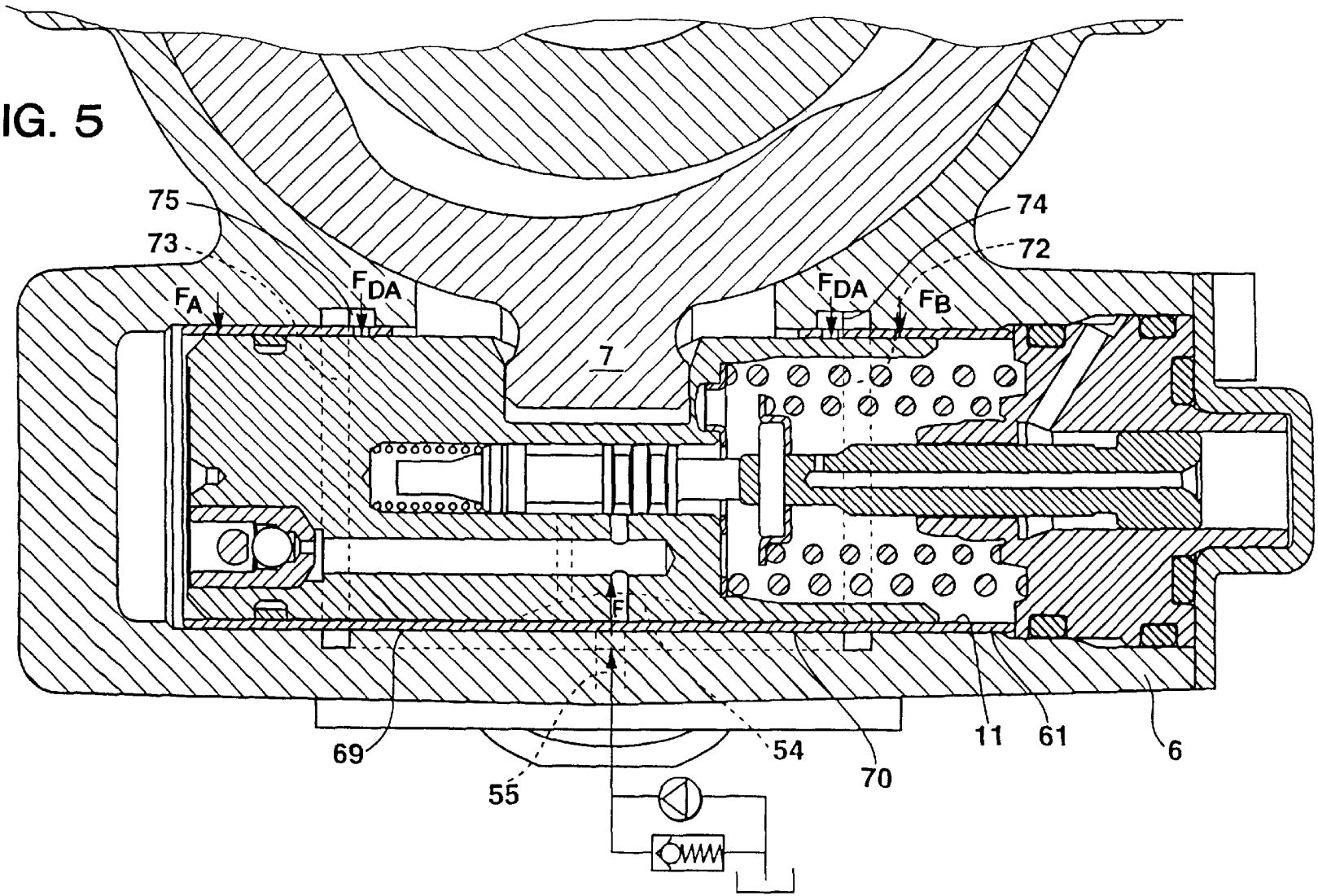
FIG. 5 shows a fourth exemplary embodiment of the invention in conjunction with a longitudinal section through an injection adjusting piston, with a first variant of the routings of the connecting conduits.

Furthermore, FIG. 5 shows a third exemplary embodiment for a relief of the injection adjusting piston 10 from damaging radial forces. This embodiment is also based on the production of a second pressure field which counteracts the first pressure field, but in this instance, it is divided into two second pressure fields in order to include as close to all of the moments being exerted on the injection adjusting piston 10 as possible. Here, too, the injection adjusting piston with the control slide valve is constructed in the same manner as in the exemplary embodiment according to FIGS. 1 and 3 so that a supplementary description with regard to it is not necessary. Diverging from the exemplary embodiment according to FIG. 1, a first connecting conduit 69 and a second connecting conduit 70 are now provided between the cylinder sleeve 61 and the adjoining housing 6 of the fuel injection pump, and these conduits, starting from the pressure fluid supply 55, extend parallel to a jacket line of the cylinder sleeve 61 and then each transition into a half-annular groove 72 and 73, which grooves respectively lead to points on the circumference of the cylinder sleeve 61 that are disposed diametrically opposite the entry of the pressure fluid supply 55 into the cylinder 11. At these points, the cylinder sleeve respectively has a first opening 75 and a second opening 74 via which the connecting conduits 69 and 70 communicate with the inside of the cylinder 11 in the region between the cylinder 11 and the jacket face of the injection adjusting piston. Second pressure fields are generated in this region and are symbolically depicted in the drawings as $F_{da}$. These forces are disposed symmetrical to the center line of the pin 7 so that they assure a uniform force compensation on the injection adjusting piston 10. They counteract the resulting pressure loads FA and FB, which result from the loading of the first pressure field in the region of the pressure fluid supply 55. They also counteract at least one force component of the tilting forces exerted on the actuating piston by the tilting moment. With the production of two second pressure fields, which are disposed essentially opposite the longitudinal groove 54, a very favorable force compensation, an improved lubrication, and therefore a significant increase in the service life and load of the injection adjusting piston 10 are obtained without high costs.

Figure 6:
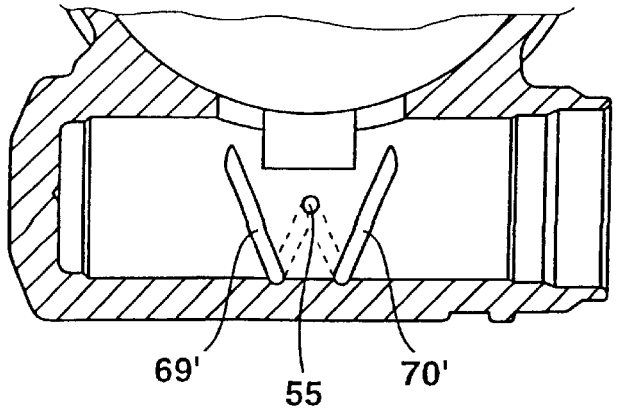
FIG. 6 shows a modification of the exemplary embodiment according to FIG. 5, with a second variant of the connecting conduits, shown on a cylinder in which the cylinder sleeve according to FIG. 5 and the injection adjusting piston have not yet been assembled.

FIG. 6 shows an alternative of the conduit routing of the connecting conduits which in this instance, extend in a spiral starting from the pressure fluid supply 55 as a first connecting conduit 69' and a second connecting conduit 70'. It is advantageous to make the connecting conduits in the form of channels which are then closed by the press-fitted cylinder sleeve up to location of the supply and the openings 75 and 74.

The foregoing relates to preferred exemplary embodiments of the invention, it being understood that other variants and embodiments thereof are possible within the spirit and scope of the invention, the latter being defined by the appended claims.

We claim:

1. A fuel injection pump comprising an injection adjusting piston (10) that serves to adjust an onset of injection and is coupled via a coupling part (7) to an adjustable part (3) of a cam drive of the fuel injection pump, said cam drive is comprised of a cam carrying part and at least one pump piston drive that follows a cam of the cam carrying part, and this injection adjusting piston defines a work chamber (14) in a cylinder (11), said work chamber is acted on by a controllable pressure fluid, by means of which the injection adjusting piston (10) is adjusted counter to a restoring force (16), a control slide valve (24), which is disposed in a cylinder bore (22) in the injection adjusting piston (10), said cylinder bore is disposed coaxial to the axis of the injection adjusting piston (10), and this control slide valve (24) is slid in the axial direction of the injection adjusting piston (10) and is adjusted by a control pressure counter to a force of a control spring (30) and in the cylinder bore (22), uses control edges (40, 46) to control a fuel communication between the work chamber (14) and a supply (48, 50, 53, 55) of pressure fluid from a pressure fluid source or to a discharge (41) of pressure fluid to a relief chamber, wherein at the location of the passage (60) of the coupling part (7) from the cam drive to the injection adjusting piston, the piston (11) is connected in a central region to an internal pump chamber (4) in which the cam drive is disposed, on one side, the injection adjusting piston (10) has a recess (9) and a jacket face, the recess is engaged by the coupling part (7) which closes the recess against a discharge pressure level of the passage (60) to the internal pump chamber (4) and between the jacket face of the injection adjusting piston (10) and a wall of the cylinder (11), at least one longitudinal groove (54) is provided which continuously communicates with a line (55) that leads from the pressure fluid source and feeds into the cylinder, and a first pressure field (66) is produced between the jacket face of the injection adjusting piston (10) and the wall of the cylinder (11) and a second pressure field is generated at a cylinder location (57, 67, 75, 74) disposed essentially diametrically opposite the recess, the second pressure field counteracts the first pressure field (66) and tilting forces on the injection adjusting piston which are caused by forces produced by the cam drive and the control slide valve (24) is actuated by an actuating piston, said control slide valve (24) is disposed outside the injection adjusting piston (10), coaxial to said piston and is counteracted by the control spring, and the recess (9) in the injection adjusting piston (10) is disposed in a part of the longitudinal span of the injection adjusting piston (10), and the control slide valve (24) is also disposed in this part.

2. The fuel injection pump according to claim 1, in which the at least one second pressure field is generated by a compression spring clamped between the recess and the coupling part.

3. The fuel injection pump according to claim 1, in which that at least one second pressure field is generated by virtue of the fact that the location (57, 67, 75, 74) communicates with the longitudinal groove (54) by means of a connecting conduit.

4. The fuel injection pump according to claim 3, in which in the recess (9), the coupling part (7) encloses a pressure chamber (57) which, as a location disposed essentially opposite the longitudinal groove (54), continuously communicates with the longitudinal groove (54), and that at least one second pressure field is generated in this pressure chamber.

5. The fuel injection pump according to claim 4, in which by means of a pressure conduit (53, 58), the longitudinal groove (54) and the pressure chamber (57) each continuously communicate with an annular groove (51) provided on the control slide valve (24).

6. The fuel injection pump according to claim 3, in which an additional recess (67) is provided between the jacket face of the injection adjusting piston (10) and the wall of the cylinder, and the second pressure field is produced in a region of this additional recess, as a location that is disposed essentially opposite the longitudinal groove (54).

7. The fuel injection pump according to claim 6, in which by means of a pressure conduit (53, 68), the longitudinal groove (54) and the additional recess (67) continuously communicate with an annular groove (51) provided on the control slide valve (24).

8. The fuel injection pump according to claim 6, in which the additional recess is embodied as a longitudinal groove (67).

9. The fuel injection pump according to claim 8 in which in relation to the longitudinal groove (54) and the additional recess (67), channels (71, 72) are provided that are each parallel to the respective recess, respectively protrude beyond the recess longitudinal grooves (54) and (67) in their longitudinal directions, and deed into a relief chamber (15) with their one end.

10. The fuel injection pump according to claim 3, in which two connecting conduits (69, 70) respectively lead from the longitudinal groove (54) to an exit (73, 74) in the region between the jacket face of the injection adjusting piston (10) and the wall of the cylinder (11), and these connecting conduits are disposed on both sides of the coupling part (7) and, as a location disposed essentially opposite from the longitudinal groove, essentially in a common radial plane.

11. The fuel injection pump according to claim 1, in which the injection adjusting piston (10) is guided in a cylinder sleeve (61) that is made of abrasion resistant material and is open in the region of the recess (9), said sleeve is inserted into the housing (6) of the fuel injection pump, which is made of less abrasion resistant material.

12. The fuel injection pump according to claim 10, in which the injection adjusting piston (10) is guided in a cylinder sleeve (61) that is made of abrasion resistant material and is open in the region of the recess (9), which sleeve is inserted into the housing (6) of the fuel injection pump, which is made of less abrasion resistant material, and the connecting conduits (69, 70, 71, 72) are embodied as channels incorporated into the wall of the housing, which are closed by the cylinder sleeve (61), and at the end of each of these channels, the cylinder sleeve (61) has an opening (75, 74), and these openings constitute the exits of the connecting conduits.

13. The fuel injection pump according to claim 10, in which the connecting conduits (69, 70) extend in a spiral shape from the longitudinal groove (54) to their exits (75, 74).

14. The fuel injection pump according to claim 11, in which the injection adjusting piston (10) has an annular groove (63) into which a metallic sealing ring (64) is inserted, which rests elastically against the inner jacket face of the cylinder sleeve (61).

15. The fuel injection pump according to claim 1, in which a first conduit (48) and second conduit (56) are provided in the injection adjusting piston (10), each of the first and second conduits connect the work chamber (14) to the cylinder bore (22), wherein an infeed of the first and second conduits is respectively controlled by one of two control edges (40, 46) of the control piston (24) and the injection adjusting piston (10) is actuated by means of an actuating piston (33, 28), which is disposed outside the injection adjusting piston and can be adjusted by the control pressure.

16. The fuel injection pump according to claim 8, in which in relation to the longitudinal groove (54) and the additional recess (67), channels (71, 72) are provided that are each parallel to the respective recess, respectively protrude beyond the recess longitudinal groove (54) and the (67) in their longitudinal directions, and feed into a relief chamber (15) with their one end.

17. The fuel injection pump according to claim 12, in which the connecting conduits (69, 70) extend in a spiral shape from the longitudinal groove (54) to their exits (75, 74).

18. The fuel injection pump according to claim 12, in which the injection adjusting piston (10) has an annular groove (63) into which a metallic sealing ring (64) is inserted, which rests elastically against the inner jacket face of the cylinder sleeve (61).

* * * * *